US005163379A

United States Patent [19]

Chorley

[11] Patent Number: 5,163,379

[45] Date of Patent: Nov. 17, 1992

[54] DEPLOYMENT OF MINES AND OTHER OBJECTS AT SEA

[75] Inventor: Michael Chorley, Weymouth, England

[73] Assignee: The Secretary of State for Defence in Her Britannic Majesty's Government of the United Kingdom of Great Britain and Northern Ireland, London, England

[21] Appl. No.: 571,586

[22] PCT Filed: Oct. 12, 1989

[86] PCT No.: PCT/GB89/01204

§ 371 Date: Aug. 23, 1990

§ 102(e) Date: Aug. 23, 1990

[87] PCT Pub. No.: WO90/04538

PCT Pub. Date: May 3, 1990

[30] Foreign Application Priority Data

Oct. 24, 1988 [GB] United Kingdom ..... 8824870

[51] Int. Cl.[5] ..... B63G 8/28

[52] U.S. Cl. ..... 114/317; 114/125

[58] Field of Search ..... 114/245, 244, 242, 125, 114/121, 330, 333, 316-319, 18; 441/29, 28

[56] References Cited

U.S. PATENT DOCUMENTS

| | | | |
|---|---|---|---|
| 3,541,989 | 11/1970 | Leonard | 114/245 |
| 3,782,317 | 1/1974 | Kriedt et al. | 114/52 |
| 3,897,743 | 6/1975 | Schoonman | 114/16 |
| 3,909,774 | 9/1975 | Pavey, Jr. | 340/7 |
| 4,019,453 | 4/1977 | Boswell et al. | 114/245 X |
| 4,745,583 | 5/1988 | Motal | 114/245 X |

FOREIGN PATENT DOCUMENTS

| | | |
|---|---|---|
| 2316576 | 1/1977 | France . |
| 611292 | 10/1948 | United Kingdom . |
| 851374 | 10/1957 | United Kingdom . |
| 846359 | 8/1958 | United Kingdom . |
| 1434357 | 5/1976 | United Kingdom . |
| 1528367 | 12/1978 | United Kingdom . |
| 2120606A | 12/1983 | United Kingdom . |
| 2142432A | 6/1984 | United Kingdom . |
| 2177352A | 6/1986 | United Kingdom . |
| 2185055A | 12/1986 | United Kingdom . |

*Primary Examiner*—Edwin L. Swinehart

*Attorney, Agent, or Firm*—Nixon & Vanderhye

[57] ABSTRACT

An object deployment unit for use under various sea states which allows deployment of objects (1) in any required sequence the deployment unit comprising a flexible tube shaped elongate body, means (2) to releasably attach objects to the body, one or more ballast members (3*a*, *b*), one or more buoyancy members (4) and a means for automatic buoyancy control. Preferably the deployment unit also includes a remotely actuated release mechanism for the release of objects. The automatic buoyancy control means ensures maintenance of depth. Typical usage is the deployment of mines.

12 Claims, 3 Drawing Sheets

FIG. 1(a)
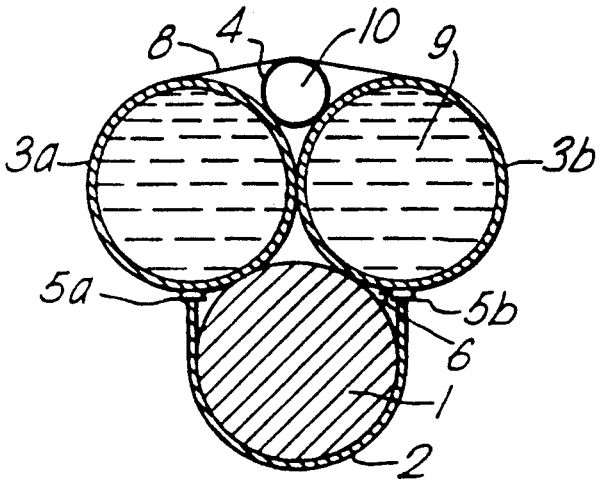
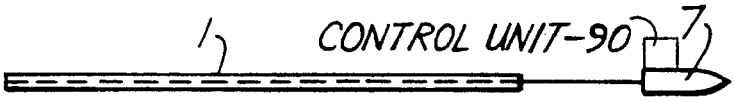
FIG. 1(b)
FIG. 2(a)
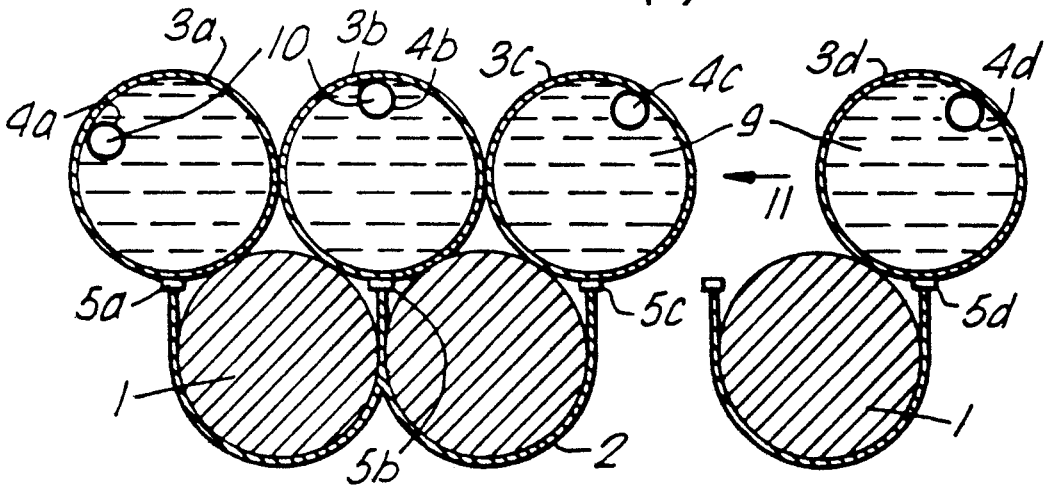
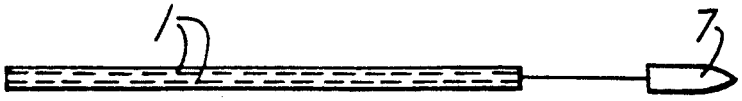
FIG. 2(b)

FIG. 3(a)
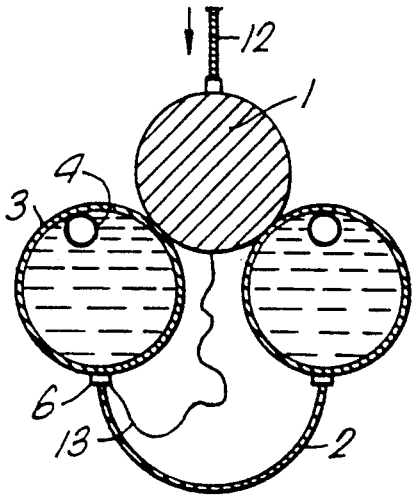
FIG. 3(b)
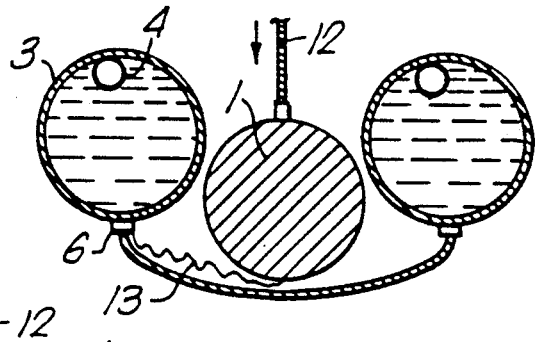
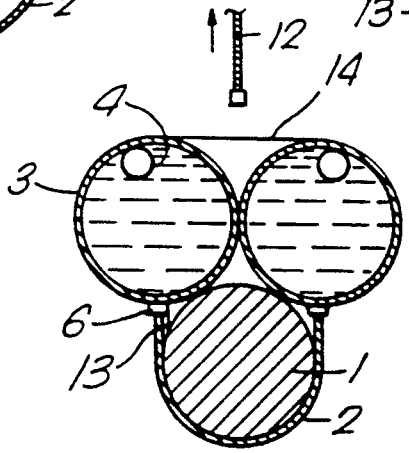
FIG. 3(c)
FIG. 4
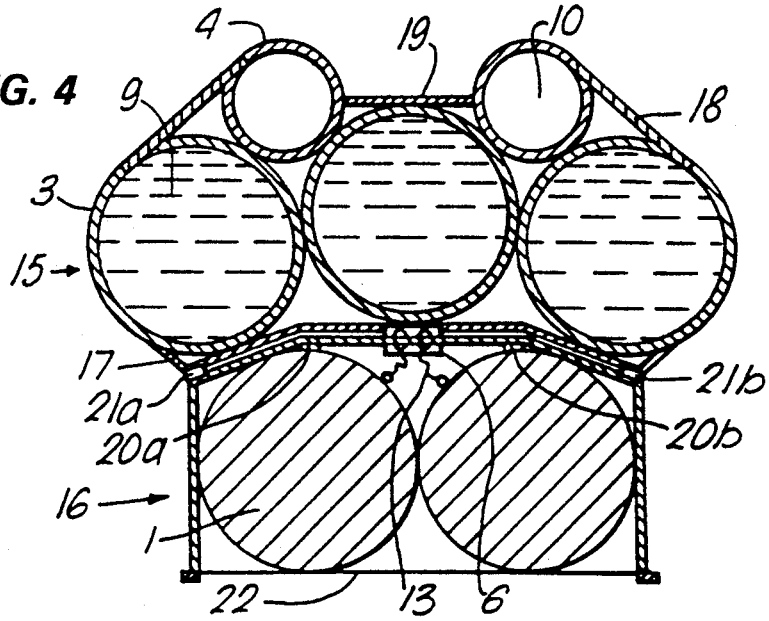

FIG. 5
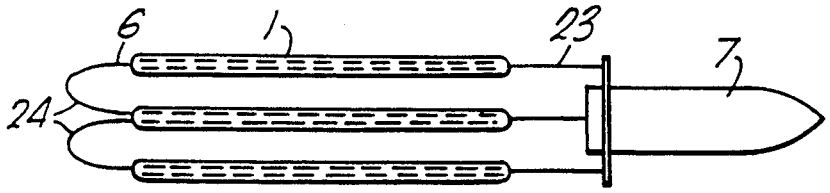
FIG. 6
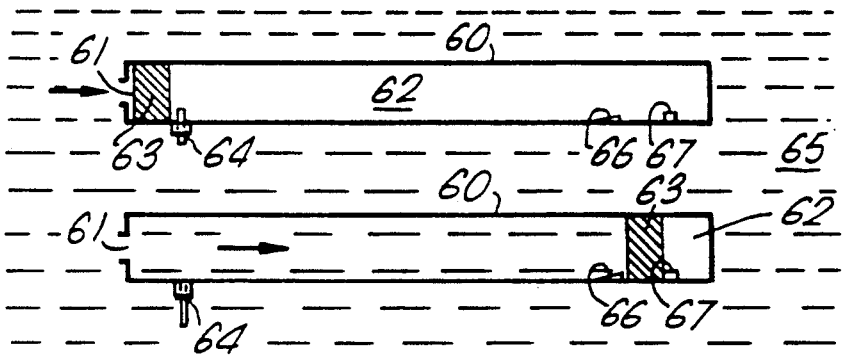
FIG. 7(a) FIG. 7(c) FIG. 7(d)
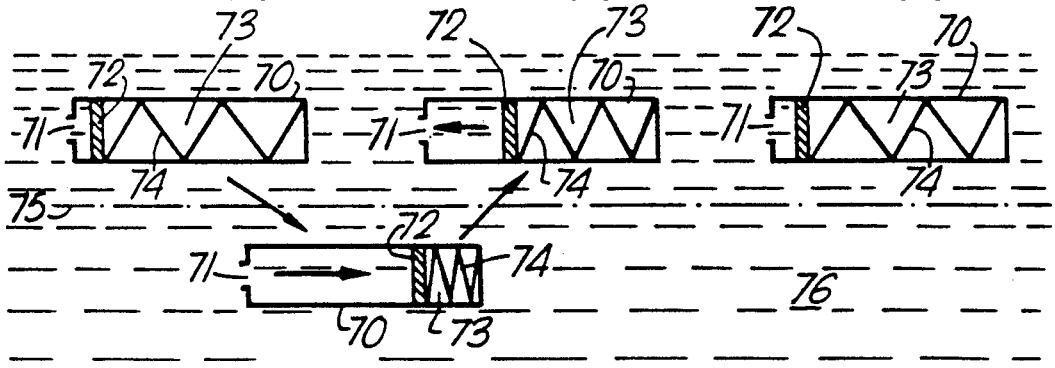
FIG. 7(b)
FIG. 8
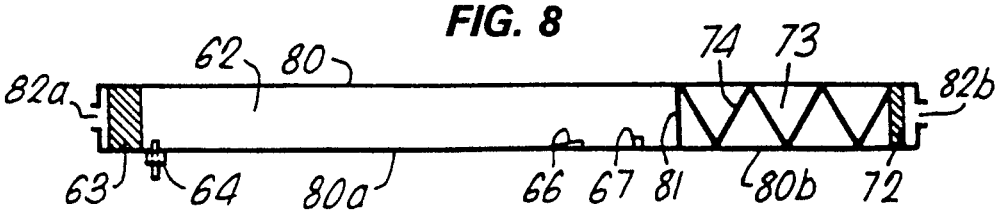

DEPLOYMENT OF MINES AND OTHER OBJECTS AT SEA

BACKGROUND OF THE INVENTION

1. Field of the Invention

The invention relates to the deployment of objects at sea, principally, but not exclusively, to the deployment of mines.

2. Discussion of Prior Art

Mines and other objects can be deployed at sea by aircraft, surface ships, submarines or small, self-propelled vehicles. Usually minelayer ships or converted commercial ships such as ferries or oil support vessels are used. The mines are then launched from the ship by trolley or inclined ramp.

Navies are tending to use dedicated minelayer ships less, with the intention being to use converted commercial ships in times of hostilities. Such ships are vulnerable to attack, particularly in a period leading up to hostilities. Additionally, the major proportion of mines will be carried in a very few ships making the potential effect of the loss of even one ship very heavy.

There is thus a need for a transportable container which is easily handled and safe when towed even in extreme sea states whilst being suitable for carrying and deploying solid objects like mines.

SUMMARY OF THE INVENTION

The object of the invention is to provide an improved deployment system for mines or other objects enabling delivery by ship, submarine or self propelled delivery unit.

The invention provides an object deployment unit comprising:

a) a flexible tube shaped elongate body;

b) means to releasably attach objects to the body;

c) one or more ballast members;

d) one or more buoyancy members; and e) means for automatic buoyancy compensation.

The deployment unit is preferably suitable for towing by surface ship or submarine, or for the inclusion of a motor to form a self-propelled delivery unit. Even relatively small vessels can usefully be used to tow such deployment units.

The unit can be towed on or below surface. A surface ship can tow it on the surface or depressed below the surface. The unit can be depressed by a kite or by an active depressor for example in the unit nose section. Such an active depressor eases handling of the unit and lessen the effect of environmental limiting conditions. A submarine will tow the unit below the surface and a mobile delivery unit can tow on or below the surface. Sub-surface tows are particularly useful for covert deployment of objects.

For submarine mine deployment the towed unit has many advantages over known forms. The submarine's defensive and offensive weapon stock is not depleted by carrying mines in torpedo storage areas. An alternative method of carrying mines by submarine uses body belts around the submarines. These have problems in that they increase the noise flow. Additionally there is the possibility of danger to the submarine from sympathetic detonations of the mines. The towed unit avoids these problems. The towed unit can, further, provide a launch platform for other weapons systems and thus complement the submarine's effectiveness.

An on-surface tow requires positive buoyancy, whereas a sub-surface tow requires negative but near neutral buoyancy.

A wide range of unit configurations is possible. Preferred arrangements, because of their simplicity of construction, are:

a) a single line of objects in the body;

b) a dual line of objects side by side in the body; or c) a surface raft of a plurality of bodies attached together.

Any convenient number of units can be towed behind a vessel at a time.

The major component of the unit is in the form of ballast. Preferably water filled sections, such as tubes, provide mass compliancy together with neutral trim. At the time of preparing the unit for arming and launch the ballast tubes can be initially air filled. Following launch, sea water can be pumped in to form the required ballast state.

Buoyancy members provide the displacement flotation to support the unit. These may be gas filled tubes, members of or containing compressible materials or members of or containing solid, non-compressible materials, as appropriate for the required uses of the unit.

A surface towed unit should be positively trimmed at all times. The resultant progressive increase in buoyancy as objects are released may cause problems and thus automatic compensation is preferably provided. This can be by venting air to reduce the flotation tube volume and can advantageously be triggered electrically or mechanically e.g. by a snatch cord, following object release.

For a sub-surface tow the trim must be rapidly adjusted following weapon release to maintain the tow stability and reduce the risk of an accidental surface broach by the depleted unit.

Buoyancy compensation can be effected by venting air. However, for covert operation the noise emission and possible increase in target size generated by the expiration of buoyancy air must be minimised. Advantageously a non-venting buoyancy control is provided. Preferably this comprises a rigid flotation chamber having a first chamber containing a gas and a second chamber open to the water, the chambers being separated by a diaphragm or piston. Advantageously a piston is used and is held in a first position by a stop means with the first chamber filled with air when open to atmospheric pressure. As the unit moves deeper the water pressure increases, increasing the pressure in the second chamber. When the stop means holding the piston is released e.g. when an object is dropped, the water pressure causes the piston to move, compressing the gas in the first chamber. A non-return catch and end stop can hold the piston in position such that the increase in buoyancy caused by the dropping of the object is compensated for by the decrease in buoyancy from the compression of the gas in the first chamber.

Preferably the unit is fabricated from near neutral buoyant materials and so requires minimal compensation.

For sub-surface operation the unit is preferably arranged with a bistatic trim. This has two trim states of positive and negative. The positive trim enables the unit to float on the surface, for example for initial attachment to the towing vessel. The negative, preferably near neutral, trim is used during dived periods and reduces the likelihood of the unit broaching the surface when in transit or during stopped periods while submerged.

A bistatic buoyancy control preferably comprises a rigid flotation chamber having a first chamber containing a gas and a second chamber open to the water, the chambers being separated by a diaphragm or piston. Preferably a diaphragm is used, which is supported by a differential spring that backs off the external hydrostatic pressure when shallower than a selected trim change depth, providing positive buoyancy, and is compressed by the increasing external hydrostatic pressure as the unit is towed down through the selected trim change depth, thus compressing the gas and effecting the required displacement. Advantageously automatic passive trim changes can occur each time the unit passes through the selected trim change depth.

The payload compensation and bistatic buoyancy control devices can advantageously be combined into a single composite device.

Preferably the body and the ballast and buoyancy members are formed of flexible tubes.

Preferably the assembled unit is encapsulated in a strong sheath with a tapered nose and tail to reduce the hydrodynamic form and skin drag. Conveniently the objects to be deployed are distributed along the length of the body, advantageously within a body confine. Preferably the objects are attached by remotely activated release mechanisms. Advantageously the object and release mechanisms are accessed from a program and control unit via an umbilical central communication spine, running the full length of the body. Preferably the program and control unit is on board the towing vessel or included in a mobile delivery unit. Advantageously the program and control unit is a "carry aboard" unit for use on towing vessels.

When used for mines the program and control unit preferably transmits mine targetting parameters immediately prior to weapon release, followed by automatic pre-release testing. The information is directed to the appropriate individually addressed mine bay. If there is a pre-launch check failure, another mine can be substituted. This has the advantage that the unserviceable mine can be returned for maintenance, if desired or practicable, thus making this deployment arrangement more economic than systems where mines have to be jettisoned if faulty to clear the launch rail. Further, the ability to address any mine along the unit eliminates the requirement for the mines to be embarked in their laying order.

BRIEF DESCRIPTION OF THE DRAWINGS

The invention will now be described, by way of example only, with reference to the accompanying drawings, of which:

FIGS. 1(*a*) and 1(*b*) show an object deployment unit according to the invention in cross-section and in plan view, as towed, respectively;

FIGS. 2(*a*) and 2(*b*) show an alternative configuration of an object deployment unit in cross-section and in plan view, as towed, respectively;

FIGS. 3(*a*), 3(*b*) and 3(*c*) show, in cross-section, the loading of an object into a deployment unit;

FIG. 4 shows in cross-section, an object deployment unit suitable for surface towing;

FIG. 5 shows, in plan view, a multiple tow arrangement;

FIG. 6 shows in cross-section, a payload compensation buoyancy control unit;

FIGS. 7*a*–7*d* show in cross-section, a bistatic buoyancy control unit; and FIG. 8 shows a payload compensation and bistatic buoyancy control unit for FIGS. 6 and 7 combined into a single unit.

DETAILED DISCUSSION OF PREFERRED EMBODIMENTS

As shown in FIG. 1 an object such as a mine 1 is held in a sling 2 below two elongate ballast tubes 3*a,b*, by attachment means 5*a,b*. An umbilical spine 6 runs along one of the ballast tubes 3*b* and one of the attachment means 5*b* comprises a release mechanism that can be remotely activated via the umbilical 6, from the towing vessel 7. Pre-launch check signals can also be sent via the umbilical 6 to check the object 1 before release. A smooth sheath 8 encases a buoyancy tube 4 and the ballast tubes 3*a,b*, to provide a smooth outer surface. Program and control unit 90 are shown in block form.

The ballast tubes 3*a,b*, are filled with water 9 to provide a compliant supporting body that yields to impact, slides smoothly past obstructions and follows the manoeuvres of the towing vessel 7 regardless of sea state. The buoyancy tube 4 is filled with air 10 to provide buoyancy for the deployment unit to compensate for the weight of the carried objects.

FIG. 2 shows an alternative configuration of the deployment unit. Two lines of objects 1 are arranged side by side, held in slings 2 under ballast tubes 3 as shown in FIG. 1. In this arrangement the air filled buoyancy tubes 4 are contained within the water filled ballast tubes 3. Further sections 11 can be added to the unit to form a raft type unit of as many lines of objects as is desired.

FIG. 3 illustrates a method of loading an object 1 into the unit. The object 1 is attached to a support 12, such as a chain, suspended from, for example, a crane (not shown). An electrical cable 13 connects the object 1 to the umbilical 6. The object 1 is lowered (b) into the sling 2 below the two ballast tubes 3, containing buoyancy tubes 4. When the object 1 is in position the support 12 is released and the weight of the object 1 closes the ballast tubes 3 together (c). A cover 14 closes the unit.

FIG. 4 shows an object deployment unit that is particularly useful for surface towing. It is formed in two sections that can be decoupled: a transit section 15 and an object container section 16. The transit section 15 comprises three ballast tubes 3 and two buoyancy tubes 4 on a base 17. Sheath sections 18 enclose the sides of the transit section 15. On the top of the transit section is a rigid walkway 19 to enable a person to walk along the unit if required. The objects 1 are held in the container section 16 by attachments 20. Each object 1 is connected to an umbilical spine 6 by cables 13. The container section 16 is coupled to the transit section 15 by couples 21*a* and *b*. A drag reduction membrane 22 closes the base of the container section 16. The container section 16 can be used for storage of the objects and can easily be coupled to the transit section with the aid of, for example, a fork lift truck (not shown).

FIG. 5 shows a towing vessel 7, for example an ocean tug, towing multiple deployment units. Three units of a type previously described are towed behind the vessel 7. Each unit includes a double line of objects 1 and an umbilical 6 runs from the vessel 7, via the the towing lines 23 along the units and back via umbilical data links 24. This arrangement provides a secondary route for data communication in the event that one of the direct data links, 23*a,b* or *c* should fail.

FIGS. 6,7 and 8 illustrate various byouancy contorl devices which can be used to control the buoyancy of a sub-surface towed object deployment unit.

FIG. 6 shows a simple payload compensation buoyancy control unit. A rigid chamber 60 has an opening 61 at one end. The chamber 60 contains air 62 at atmospheric pressure and is sealed by a piston 63. The piston 63 is held in position by a piston release 64 to prevent it moving under pressure from the surrounding water 65. The buoyancy control unit is attached to an object deployment unit of a type previously described and when an object is released the piston release 64 is removed by a solenoid or pull cord (not shown) to allow the piston 63 to move. The external water pressure forces the piston 64 to move to compress the air 62 in the chamber 60. A piston non-return catch 66 and end stop 67 hold the piston 63 in position with the air 62 compressed. The decrease in buoyancy from the compression for the air 62 and the filling of the chamber 60 with water 65 compensates for the increase in buoyancy created when an object is jettisoned from the unit.

FIG. 7 shows a bistatic buoyancy control unit which allows increased buoyancy above a certain pressure level, to enable the unit to float, and allows a decreased buoyancy below that pressure level. In this way automatic passive trim changes occur each time the unit passes through the differential depth. The buoyancy control unit comprises a rigid chamber 70 that has an opening 71 at one end. A diaphragm 72 traps air 73 at at atmospheric pressure in the chamber 70(*a*). The diaphragm 72 is supported by a differential spring 74. When the unit is shallower than a selected trim change depth 75 the spring 74 backs off the hydrostatic pressure from the surrounding water 76 and the air 73 in the chamber 70 can expand (a). As the unit is taken below the trim change depth 75 the increasing external water pressure causes the spring 74 to collapse, compressing the air 73 and effecting the required displacement (b). As the unit is brought back above the trim change depth 75 the spring 74 expands again allowing the air 73 to expand (c) (d) to increase buoyancy again.

FIG. 8 shows a combined payload compensation and bistatic buoyancy control unit. A chamber 80 is divided into two by a fixed divider 81 and has two openings 82*a*,82*b*. A first side 80*a* of the chamber is filled with air 62 at atmospheric pressure. As described in relation to FIG. 6 a piston 63 is held in position against external water pressure by a piston release 64. When released, the piston 63 is moved to a position held by a non-return catch 66 and end stop 67, compressing the air 62 between the piston 63 and the divider 81. A second side 80*b* of the chamber is also filled with air 73 at atmospheric pressure. The chamber is sealed by a diaphragm 72 supported by a differential spring 74 as described in relation to FIG. 7. In this way changes of buoyancy due to depth changes or jettisoning of an object can be automatically effected by a single buoyancy control unit.

An object deployment unit according to the invention is particularly useful for transporting and deploying mines but can also be used for many other objects, for example position markers, sonobuoys, equipment, other weapons. In some arrangements, divers may be carried within a confine in the unit body and in this case the term "object" is taken to include divers or other personnel. It gives increased flexibility and effectiveness to object deployment vessels and minimal fitting out of towing vessels is required.

I claim:

1. A deployment unit for dispensing objects in water, the unit comprising a flexible tube shaped elongate body which further comprises:
   a) at least one ballast member
   b) at lest one buoyancy member;
   c) a remote program and control unit;
   d) means for releasably attaching objects to be dispensed, wherein said attaching means comprises a remotely activated individual release mechanism, said release mechanism responsive to said program and control unit; and
   e) means for automatic buoyancy compensation upon release of said objects.

2. A deployment unit according to claim 1 wherein said means for automatic buoyancy compensation is a non-venting buoyancy control to prevent the expiry of air.

3. A deployment unit according to claim 2 wherein said means for automatic buoyancy compensation is a payload compensation device which comprises:
   a rigid flotation chamber;
   a piston defining first and second chambers within said rigid flotation chamber, said first chamber containing air and said second chamber open to said water; and
   releasable stop means for holding said piston in position against incident water pressure.

4. A deployment unit according to claim 3 wherein said stop means, responsive to release of said object, permits said piston to be moved by water pressure thereby compressing said air in said first chamber.

5. A deployment unit according to claim 4 further including a non return catch for holding said piston in said position compressing said air in said first chamber whereby any increase in buoyancy caused by the release of said object is compensated for by the decrease in buoyancy from the compression of the air in said first chamber.

6. A deployment unit according to claim 1 further including a bistatic trim means for providing positive and negative trim states.

7. A deployment unit according to claim 6 wherein said bistatic trim means comprises:
   a rigid flotation chamber;
   a piston defining a first chamber and second chamber within the rigid flotation chamber, said first chamber containing air and said second chamber open to the water;
   a differential spring supporting said piston against external hydrostatic pressure such that when said unit is shallower than a selected trim change depth it is positively buoyant, and said spring being increasingly compressed by increasing external hydrostatic pressure acting on the said piston and thus compressing said air and as the unit is towed below said selected trim change depth, said unit becoming negatively buoyant.

8. A deployment unit according to claim 6 wherein said means for automatic buoyancy compensation and said bistatic trim means are combined into a single composite device including a common rigid flotation chamber.

9. A deployment unit according to claim 1 wherein said ballast and said buoyancy members are formed of flexible tubes.

10. A deployment unit according to claim 1 wherein said objects comprise mines.

11. A deployment unit according to claim 10 wherein said program and control unit transmits targeting parameters prior to release, followed by automatic prerelease testing.

12. A deployment unit according to claim 1 wherein the deployment unit further includes a strong sheath surrounding at least said ballast member and said buoyancy member, said sheath including a tapered nose and tail to reduce the hydrodynamic form and skin drag.

* * * * *